US006224258B1

(12) United States Patent
Dodson

(10) Patent No.: US 6,224,258 B1
(45) Date of Patent: May 1, 2001

(54) STORAGE SYSTEM INCLUDING BAG WITH HOLE REINFORCING STRUCTURE

(76) Inventor: Darren W. Dodson, 1231 Matx Cir., Sedalia, MO (US) 65301

( * ) Notice: Subject to any disclaimer, the term of this patent is extended or adjusted under 35 U.S.C. 154(b) by 0 days.

(21) Appl. No.: 09/286,662

(22) Filed: Apr. 6, 1999

Related U.S. Application Data

(60) Provisional application No. 60/080,762, filed on Apr. 6, 1998.

(51) Int. Cl.[7] ..... B65D 33/10

(52) U.S. Cl. ..... 383/9; 383/22; 383/25; 383/37; 383/63; 383/113

(58) Field of Search ..... 383/9, 22, 25, 383/37, 63, 65, 113; 24/713.6, 12.1, 473, 549, 713.7, 713.8, 599.5

(56) References Cited

U.S. PATENT DOCUMENTS

| | | | | |
|---|---|---|---|---|
| 501,875 | * | 7/1893 | Cutter | 24/599.5 |
| 590,933 | * | 9/1897 | Lueders | 24/599.5 |
| 1,502,386 | * | 7/1924 | Hill | 24/599.5 X |
| 1,790,056 | * | 1/1931 | Moody | 24/599.5 X |
| 2,748,047 | * | 5/1956 | Kuss | 383/9 X |
| 2,788,822 | * | 4/1957 | Parker | 383/9 X |
| 2,790,591 | * | 4/1957 | Rosen | 383/9 |
| 2,878,849 | * | 3/1959 | Lingenfelter et al. | 383/37 X |
| 3,208,660 | * | 9/1965 | Brieske | 383/9 |
| 3,328,854 | * | 7/1967 | Tombari | 24/713.7 X |
| 3,646,723 | * | 3/1972 | Meroney | 383/9 X |
| 4,290,467 | * | 9/1981 | Schmidt | 383/9 |
| 4,397,061 | * | 8/1983 | Kanzaka . | |
| 4,787,755 | * | 11/1988 | Branson | 383/65 |
| 4,843,994 | * | 7/1989 | Wilson et al. | 383/22 X |
| 4,846,586 | * | 7/1989 | Bruno | 383/65 X |
| 4,852,732 | * | 8/1989 | Wilski et al. . | |
| 5,267,643 | * | 12/1993 | Scribner | 383/9 X |
| 5,647,107 | * | 7/1997 | Brewster | 24/713.6 |
| 5,935,304 | * | 8/1999 | Shelley et al. . | |

FOREIGN PATENT DOCUMENTS

| | | | | |
|---|---|---|---|---|
| 2257819 | * | 2/1964 | (DE) | 383/9 |
| 680596 | * | 2/1964 | (CA) | 383/9 |

* cited by examiner

*Primary Examiner*—Allan N. Shoap
*Assistant Examiner*—Robin A Hylton
(74) *Attorney, Agent, or Firm*—Oliff & Berridge, PLC

(57) ABSTRACT

A storage system for objects includes a reclosable bag. A hole is provided in the bag, with a hole reinforcing structure, such as a grommet, provided to reinforce the hole. A fastener is attached to the bag via the grommet. A securing device is provided that is attachable to a structure such as a boat support member, a tree branch, or the like, and the bag can be selectively attached to and removed from the structure directly or via the securing device.

16 Claims, 3 Drawing Sheets

STORAGE SYSTEM INCLUDING BAG WITH HOLE REINFORCING STRUCTURE

This nonprovisional application claims the benefit of U.S. Provisional Application No. 60/080,762, filed Apr. 6, 1998.

BACKGROUND OF THE INVENTION

1. Field of Invention

The invention relates to a storage system used to store objects, and, more particularly, to a storage system used in an outdoor environment.

2. Description of Related Art

People enjoy many outdoor activities, such as water activities involving boats, such as canoeing, rowing, water-skiing, fishing and so forth. In participating in such water activities, an individual must deal with the fact that water, while necessary for the intended activity, is often detrimental to any personal effects he or she may be carrying, including wallets, watches, keys, printed matter, food, electronic items, and bottles or cans of insect repellent, sunscreen and the like. Particularly in canoeing, in which there is always an increased possibility of capsizing, as compared to other types of boating, an individual constantly has the nagging responsibility of trying to maintain the dryness of his or her personal belongings.

To deal with this situation, various strategies have been employed. Some individuals simply minimize the personal belongings taken into the boat, keeping only essential items, such as keys, with them during the activity. While effective to a degree, this approach often results in personal hardship and/or deprivation to the user. Moreover, the determination of essentialness may vary from person to person, and may even vary for the same person within a given day. For example, sunscreen that was determined to be non-essential in the morning may be re-evaluated to be essential as a blistering sunburn develops, and snack items that were foregone early in the day may become more important as the boating excursion extends beyond the planned return time.

Other individuals place their personal belongings in waterproof containers, such as watertight coolers or sealable plastic containers, and keep these containers with them in the boat. While effective at keeping items dry, this approach reduces precious leg-room in the boat. Furthermore, if the boat does capsize, the individuals become immediately preoccupied with righting the boat, and have little time or ability to retrieve the container. The containers may in some cases be tied to the boat to prevent their separation from the boat at the time of capsizing. However, if there is more than one container, or if the container is not configured with a through-hole or other structure to receive the tying member, this may not be feasible. Additionally, if only one or two watertight containers are available, it is inevitable that it/they will end up holding the personal belongings of everyone in the boat, making it difficult to locate and/or retrieve one's personal belongings when desired.

SUMMARY OF THE INVENTION

To deal with the above situations, the invention provides a bag that can be easily secured to a structure, such as a canoe strut, tree branch, swimming pool structure, picnic table, chair or the like, by a securing device. A plurality of different bags may be provided, each being releasably attached to the same securing device. The bags may be of different shapes, sizes, colors, or materials, depending on the needs and/or preferences of the buyer. For example, a set of bags of progressively larger sizes (i.e., small, medium, large, extra-large) may be provided, and/or one or more bags of the set may be transparent, to allow ready identification of their contents, while other bags of the set may be opaque, to provide privacy or to protect light-sensitive items. Any or all of the bags may be colored by adding colored pigment to the material of the bags. Furthermore, the bags may be water-proof reclosable bags and/or non-watertight breathable bags.

The securing device may be a flexible, elongate member having two ends, one of which is passed through or around a structure such as a canoe strut, tree branch, swimming pool structure, picnic table, chair or the like and attached to the other end to form a closed loop. For example, the securing device may be a ball chain, a nylon web with a plastic snap-lock fastener, or even a plain rope.

Each bag has its own fastener that can be attached to the securing device. For example, the fastener can be a snap hook. The fastener is attached to the bag by first providing at least one grommet in the plastic bag, and then attaching the snap hook to the bag by threading the snap hook through the grommet, or by connecting the snap hook to the bag via an intermediate member such as a split key ring, a length of ball chain or the like.

Adhesive is preferably provided between the grommet and the bag material. This adhesive may, for example, be provided as a double-sided adhesive plastic tab.

Additionally, one or more bags may be provided with at least one protective insert to protect fragile or sensitive items and/or to provide additional flotation for relatively heavy objects.

Furthermore, a desiccant package may be provided in any or all of the bags to reduce or eliminate moisture introduced through condensation or when the bags are opened.

These and other features and advantages of this invention are described in or are apparent from the following detailed description of preferred embodiments.

BRIEF DESCRIPTION OF DRAWINGS

Preferred embodiments of this invention will be described in detail, with reference to the following Figures, in which.

DETAILED DESCRIPTION OF PREFERRED EMBODIMENTS

The invention is directed to bags that are selectively attachable to a structure such as a canoe strut, tree branch, swimming pool structure, picnic table, chair or the like. The bags are reclosable bags made, for example, from a water-proof material such as plastic. The plastic material may have a thickness, for example, in a range of about 2 mil to about 14 mil. 6 mil plastic has been shown to be successful, although it is expected that somewhat thinner plastic would also be suitable, and certainly, thicker plastic would also be suitable. The plastic may be polyethylene, or any other desired type of sheet-formable plastic material.

Although it is anticipated that users will normally desire waterproof bags, it is foreseeable that users may also want non-waterproof bags. For example, a user may need to carry items that may get wet without damage, or that would fare better if exposed to air, such as, for example, wet clothing or the like. To respond to this need, the principles of the invention may also be applied to non-airtight or non-watertight bags, such as mesh bags or bags of "breathable" material, such as canvas or cloth. Additionally, the bags may be either transparent or opaque.

Figure 1:
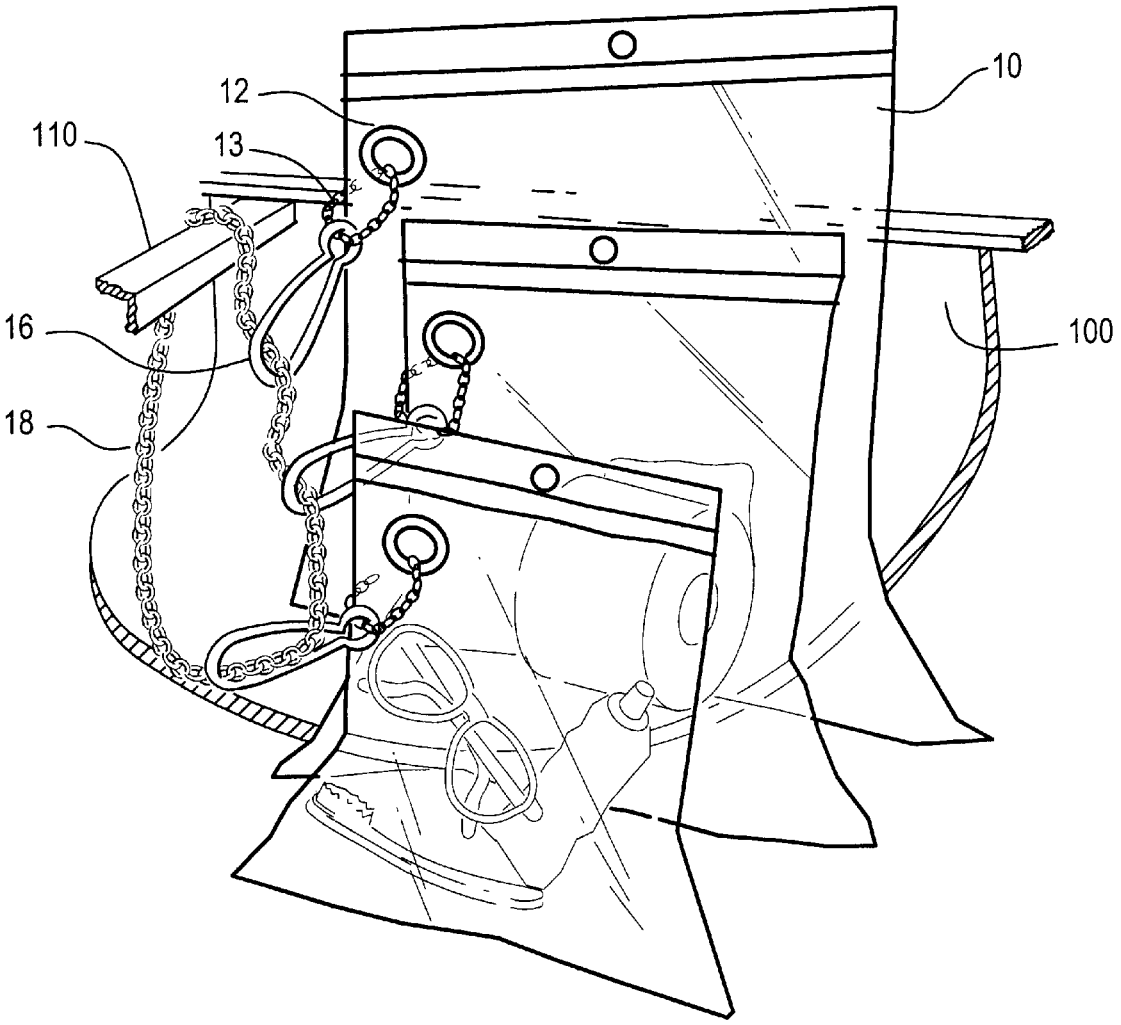
FIG. 1 shows a set of bags according to the invention.

As shown in FIG. 1, bags 10 of various sizes may be provided as a set. Grommets 12 are provided in each of the bags as hole reinforcement devices.

A fastener, such as a snap hook 16, is attached to each bag 10. There are many equivalents of the snap hook 16, and this invention anticipates all such equivalents. For example, a spring-loaded clip may be used. Other examples of fasteners include butterfly clips, threaded fasteners, snap-lock fasteners, or any combination or variation thereof.

Each snap hook 16 is attached to a respective bag 10 by an intermediate member 13. In the embodiment illustrated in FIG. 1, the intermediate member 13 is a length of ball chain. Alternatively, if the snap hook 16 is large enough, it may be attached directly to the bag 10 by threading the snap hook 16 through the grommet 12 of the bag 10. Other intermediate members, such as split key ring or the like, may also be used instead of the depicted ball chain.

A securing device 18, which may be, for example, a ball chain, is secured around a support member 110 of a boat 100. When a ball chain is used, a conventional ball chain connector (not shown) connects the ends of the ball chain together. To attach the bags 10 to the boat 100, the snap hook 16 of each bag 10 is attached to the securing device 18.

Instead of a ball chain, the securing device 18 may comprise any suitable member or members, such as a nylon web with a plastic snap-lock fastener, or even a plain rope. Additionally, the securing device need not necessarily be a flexible member. A "handcuff-type" rigid device that captures and locks around a structural member, such as the support member 110 of the boat 100, may instead be used, provided that the selected fasteners can be properly attach to the securing device.

Furthermore, while the bag 10 is depicted as being attached to a support member 110 of a boat 100, it should be appreciated that the bag 10 may be attached to any appropriate structure in any environment. For example, while a user is camping or hiking, he or she may attach the bag 10 to a tree branch or the like.

Alternatively, female or male members of snap-lock fasteners or threaded fasteners, for example, could be attached to the securing device, and counterpart male or female members of the snap-lock fasteners or threaded fasteners could be attached to the bags 10.

Since the bags 10 are attached independently to the securing device 18, any desired bag 10 may be individually removed without releasing the securing device 18 and without removing the other bags. Accordingly, the user has convenient access to any desired item at any given time. Additionally, since any desired number of bags may be provided, the user can organize his or her personal belongings to any desired degree (i.e., one item per bag, two items per bag, etc.).

Figure 2:
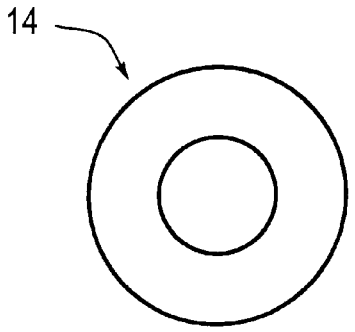
FIG. 2 shows a front view of a plastic adhesive tab according to one embodiment of the invention.
Figure 3:
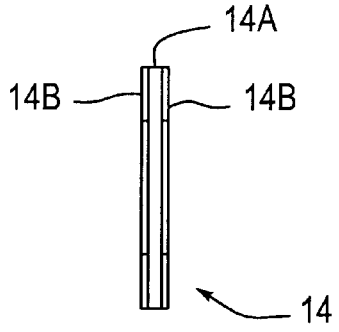
FIG. 3 shows a side view of the plastic adhesive tab of FIG. 2.
Figure 4:
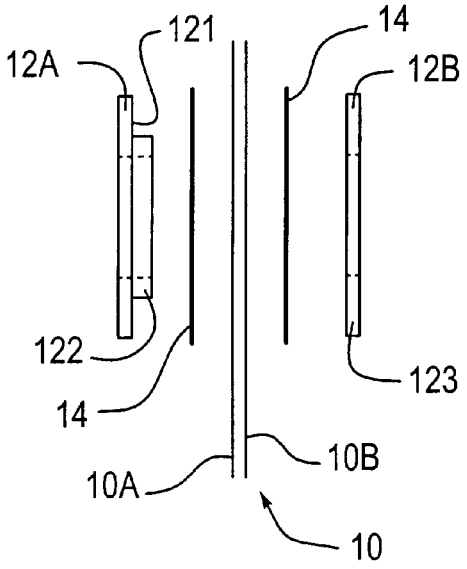
FIG. 4 shows an assembly view of a hole reinforcing structure according to one embodiment of the invention.

FIGS. 2–4 illustrate one embodiment of a hole reinforcing structure according to this invention.

FIGS. 2 and 3 illustrate front and side views, respectively, of an adhesive structure 14 used in the hole reinforcing structure. As shown in the FIG. 3, the adhesive structure 14 includes a sheet 14A with adhesive material 14B coated on each side.

FIG. 4 is an assembly view of the hole reinforcing structure. The grommet 12 includes a male portion 12A and a female portion 12B, which are matable with each other. The male portion 12A and a female portion 12B are brought together, with the bag 10, including bag sides 10A and 10B, interposed therebetween. Furthermore, one adhesive structure 14 is interposed between the male portion 12A and the bags side 10A, and another adhesive structure 14 is interposed between the female portion 12B and the bag side 10B.

During assembly, portion 122 of the male portion 12A is inserted sequentially through one adhesive structure 14, the bag side 10A, the bag side 10B, the other adhesive structure 14, and then into the female portion 12B. Holes may be provided in the adhesive structures 14 and/or the bag sides 10A and 10B in advance to accommodate the portion 122, or may be formed by punching the portion 122 through the adhesive structures 14 and/or the bag sides 10A and 10B. In the assembled state, a contact surface 121 of the male portion 12A and a contact surface 123 of the female portion 12B contact the respective adhesive structures 14.

Although the adhesive structure 14 is depicted as having a circular washer shape, any other shape may also be used. Furthermore, the adhesive structure 14 is shown to have a diameter substantially equal to an average diameter of the grommet 12, but a slightly smaller or larger diameter is also acceptable.

The adhesive structures 14 add significantly to the performance of the bag 10. In addition to providing a waterproof seal between the grommet 12 and the bag 10, the adhesive structures dramatically increase the tear-out strength of the bags by spreading out the force applied to the bag 10 at point of connection to the fastener, thus minimizing the per-unit force applied to the bag 10. For example, without the adhesive structures 14, a plastic bag was demonstrated to hold about 4 pounds before tear-out. When the adhesive structures 14 were added, with the sheets 14A of the adhesive structures 14 being a 10 mil plastic tab, the same bag was demonstrated to hold approximately 50 pounds without tearing.

While a 10 mil plastic tab was used in testing, tabs having a greater or lesser thickness are also suitable, although the strength will naturally be reduced by using thinner plastic tabs. In general, plastic tabs having a thickness in a range of about 6 mil to about 20 mil are suitable.

While best performance is expected with the adhesive structures 14 as shown and described, variations are possible. For example, although two adhesive structures 14 are used, on one each side of the bag, it is possible to provide an adhesive structure 14 on only one side. Furthermore, if the bag material itself has a sufficient strength and/or waterprooffiess is not required, the grommet 12 alone may be adequate. Additionally, instead of having a sheet 14A, the adhesive structure 14 may be formed by an adhesive directly applied or coated onto the bag sides 10A and/or 10B.

Furthermore, although the grommet 12 is depicted as having a male portion 12A and a female portion 12B, the grommet 12 may be replaced by a hole reinforcing structure formed by a simple washer attached to either or both of the bag sides 10A and 10B by adhesive.

Additionally, while the illustrated grommet 12 sandwiches both bag sides 10A and 10B, it is possible to provide a grommet 12 that sandwiches only one of the bag sides, and to provide a separate grommet 12 that sandwiches the other of the bag sides or to provide an un-reinforced hole, aligned with the grommet 12, in the other of the bag sides.

Figure 5:
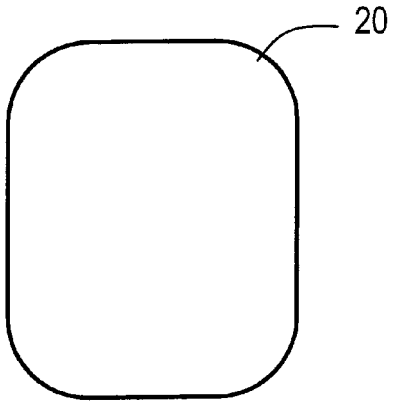
FIG. 5 shows a desiccant package according to one embodiment of the invention.

FIG. 5 shows a desiccant package 20 that may be used when the invention is practiced using waterproof bags. The desiccant package 20 may be of conventional structure and composition, and include a clay desiccant or a silica gel desiccant, for example. The desiccant package 20 is placed in a bag 10, along with moisture-sensitive items. The desiccant package reduces or eliminates moisture that enters the bag 10 while the bag 10 is open, or which condenses on the inside of the bag 10.

The bags 10 may also be provided with at least one protective insert (not shown) to protect fragile or sensitive items and/or to provide additional flotation for relatively heavy objects. For example, foamed padding or "bubble-wrap," such as is commonly used in postal or courier envelopes, may be bonded to the insides or outsides of the bags 10. Preferably, the protective insert or inserts of a given bag 10 have an air volume that is sufficient to float the contents of the bag 10 in the event that the bag 10 is accidentally dropped overboard while handling, or torn away from the securing device 18 during a capsizing event, for example.

Figure 6:
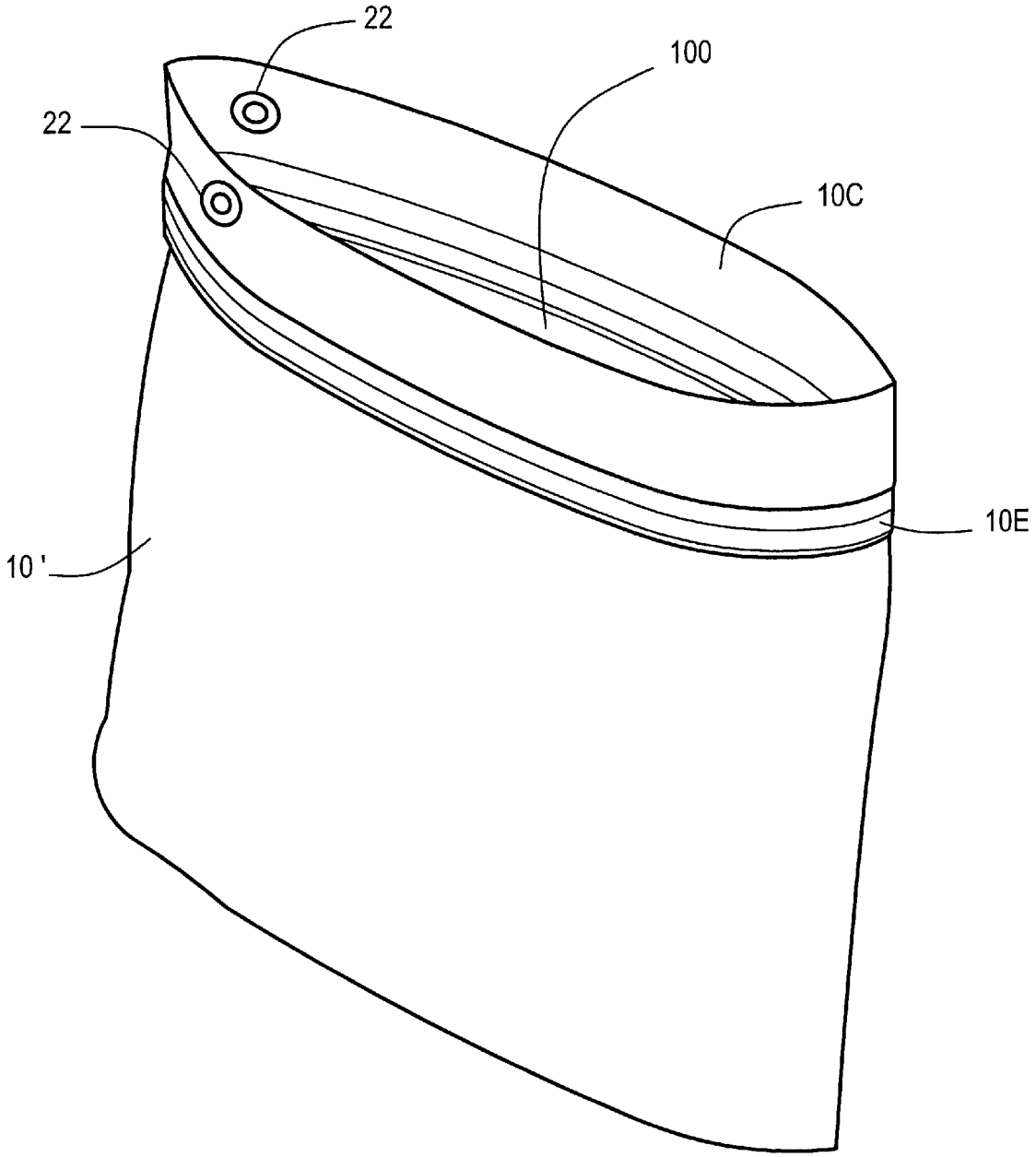
FIG. 6 shows a bag with a hole reinforcing structure according to another embodiment of the invention.

FIG. 6 illustrates a bag 10' according to another embodiment of this invention. A typical reclosable plastic bag, also known as a "zip-lock" bag, has tab portions 10C extending beyond a compartment portion 10D above the plastic "zipper" portion 10E. Grommets 22 are inserted in each of these tab portions 10C in mutually corresponding positions so that, when inserted, the two grommets 22 are substantially aligned with each other. By inserting the grommets 22 in these tab portions 10C, rather than in the compartment portion 10D, the integrity of the compartment portion 10D is not compromised. Thus, watertightness of the compartment portion can be maintained.

Although each tab portion 10C of the bag 10' is shown to have a grommet 22 attached in FIG. 6, it is possible to provide a grommet 22 in only one of the tab portions 10C. Furthermore, it is possible to use an adhesive structure, as described above, in conjunction with a grommet 22 on either or both tab portions 10C.

While the invention has been described in conjunction with the specific embodiments described above, it is evident that various alternations, modifications or substitutions may be apparent to those skilled in the art, once given this disclosure. Accordingly, the preferred embodiments as set forth above are intended to be illustrative and not limiting. Various changes can be made without departing from the spirit and scope of the invention.

Furthermore, although the specific application of the invention to a boat has been described, it is obvious that the invention easily applies to a multitude of other vehicles, structures and environments.

What is claimed is:

1. A storage system, comprising:

at least one reclosable bag having a first bag side and a second bag side, at least one of the first and second bag sides having a hole formed therein, respective holes of the first and second bag sides being aligned when the other of the first and second bag sides is also provided with a hole;

a hole reinforcing structure provided on each at least one reclosable bag around a periphery of the hole of at least one of the first and second bag sides, the hole reinforcing structure comprising a grommet including first and second matable portions, a portion of at least one of the first and second bag sides being sandwiched between the first and second matable portions when the matable portions are in an assembled state; and at least one adhesive structure interposed at least between one of the first and second matable portions.

2. The storage system as set forth in claim 1, wherein the hole reinforcing structure includes at least one adhesive structure.

3. The storage system as set forth in claim 1, wherein the adhesive structure comprises a sheet with adhesive material on at least one side thereof.

4. The storage system as set forth in claim 3, wherein the sheet comprises plastic material.

5. The storage system as set forth in claim 4, wherein the plastic material has a thickness in a range of about 6 mil to about 20 mil.

6. The storage system as set forth in claim 1, further comprising a fastener connected to the hole reinforcing structure.

7. The storage system as set forth in claim 6, further comprising a securing device that is releasably attachable to a structure, the fastener being selectively attachable to the securing device.

8. The storage system as set forth in claim 7, wherein the securing device comprises an elongate flexible member with mutually connectable ends.

9. The storage system as set forth in claim 8, wherein the elongate flexible member comprises a ball chain.

10. The storage system as set forth in claim 7, wherein a plurality of reclosable bags are provided, the plurality of reclosable bags being connected to each other via the securing device.

11. The storage system as set forth in claim 1, wherein each of the first and second bag sides includes a compartment portion, the compartment portion of the first bag side and the compartment portion of the second bag side together defining a compartment of the reclosable bag, and wherein at least one of the first and second bag sides includes a tab portion attached to the compartment portion, the hole being provided in the tab portion.

12. The storage system as set forth in claim 1, wherein the reclosable bag is waterproof, and watertight when in a closed state.

13. The storage system as set forth in claim 12, further comprising a desiccant package inside the reclosable bag.

14. A method of storing objects, comprising:

providing at least one reclosable bag to contain the objects, the at least one reclosable bag having a first bag side and a second bag side, at least one of the first and second bag sides having a hole formed therein, respective holes of the first and second bag sides being aligned when the other of the first and second bag sides is also provided with a hole;

providing at least one adhesive structure;

providing a hole reinforcing structure on the reclosable bag around a periphery of the hole of at least one of the first and second bag sides, the hole reinforcing structure comprising a grommet including first and second matable portions, the adhesive structure and a portion of at least one of the first and second bag sides being sandwiched between the first and second matable portions when the matable portions are in an assembled state;

connecting a fastener to the hole reinforcing structure; and selectively attaching the fastener to a structure.

15. The method as set forth in claim 14, further comprising:

providing a securing device that is releasably attachable to the structure; and securing the securing device to the structure, wherein the fastener is attached to the structure via the securing device.

16. The method as set forth in claim 15, wherein a plurality of reclosable bags are provided, the plurality of reclosable bags being connected to each other via the securing device.

* * * * *